US009722341B2

(12) United States Patent
Chikusa et al.

(10) Patent No.: US 9,722,341 B2
(45) Date of Patent: Aug. 1, 2017

(54) CONNECTOR WITH STREAMLINE LOCKING LANCES

(71) Applicant: Sumitomo Wiring Systems, Ltd., Yokkaichi, Mie (JP)

(72) Inventors: Takahiro Chikusa, Mie (JP); Shinji Iihoshi, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/161,340

(22) Filed: May 23, 2016

(65) Prior Publication Data

US 2016/0365663 A1 Dec. 15, 2016

(30) Foreign Application Priority Data

Jun. 9, 2015 (JP) ..... 2015-117012

(51) Int. Cl.
*H01R 13/514* (2006.01)
*H01R 13/422* (2006.01)
*H01R 13/506* (2006.01)

(52) U.S. Cl.
CPC ..... *H01R 13/4223* (2013.01); *H01R 13/506* (2013.01); *H01R 13/514* (2013.01)

(58) Field of Classification Search
CPC ..... H01R 13/424
USPC ..... 439/752
See application file for complete search history.

(56) References Cited

U.S. PATENT DOCUMENTS 5,951,326 A * 9/1999 Okabe ..... H01R 13/501 439/596
6,146,200 A * 11/2000 Ito ..... H01R 13/516 439/596
6,375,501 B1 * 4/2002 Kojima ..... H01R 13/4223 439/382
6,375,504 B1 * 4/2002 Ito ..... H01R 13/447 439/596
6,585,543 B2 * 7/2003 Kuroda ..... H01R 13/432 439/752
7,044,809 B2 * 5/2006 Kuroda ..... H01R 43/16 439/660
7,632,158 B2 * 12/2009 Denpouya ..... H01R 13/4367 439/488

FOREIGN PATENT DOCUMENTS

JP 10-162888 6/1998
JP 10162888 A * 6/1998

* cited by examiner

*Primary Examiner* — Tulsidas C Patel
*Assistant Examiner* — Peter G Leigh
(74) *Attorney, Agent, or Firm* — Gerald E. Hespos; Michael J. Porco; Matthew T. Hespos

(57) ABSTRACT

A connector is miniaturized and while still preventing damage to locking lances. Deflectable first and second locking lances (19, 79) configured to lock first and second terminal fittings (11, 61) are arranged to be exposed on first and second facing surfaces (15, 75) of first and second housings (10, 60). When the first and second housings 10, 60 are assembled, the first and second locking lances (19, 79) are arranged back-to-back with each other. Surfaces of the first and second locking lances (19, 79) facing the first and second cavities (17, 77) on tip parts in a projecting direction are continuous without any step and include locking surfaces (23, 83) configured to lock the first and second terminal fittings (11, 61) on tips in the projecting direction.

2 Claims, 13 Drawing Sheets

CONNECTOR WITH STREAMLINE LOCKING LANCES

BACKGROUND

1. Field of the Invention

The invention relates to a connector.

2. Description of the Related Art

Japanese Unexamined Patent Publication No. H10-162888 discloses a connector with two housing units to be laminated together. Each housing unit includes a resilient locking lance for locking a terminal fitting. The locking lance is arranged so that the back surface of the locking lance is exposed on an outer surface of the housing unit. When the two housing units are laminated together, the locking lances exposed on the outer surfaces of the housing units are held in back-to-back contact with each other to restrain mutual resilient displacements thereby firmly retaining a locked state of the terminal fittings.

The locking lance is cantilevered forward in an inserting direction of the terminal fitting, and a projection for locking the connection terminal is provided is arranged behind the tip of the locking lance in the projecting direction.

A recessed step is formed before the projection on a surface side of the tip part of the locking lance in the projecting direction facing a terminal accommodating chamber.

No wall partitions between the locking lances of the housing units when the housing units are laminated together, thereby contributing to the miniaturization (height reduction) of the connector in the height direction. However, as the housing units are miniaturized, the projections on the locking lances become very small. Thus, the projection may be sheared when an external force acts on the connection terminal in a rearward pull-out direction.

The invention was completed based on the above situation and aims to provide a connector capable of being miniaturized and preventing the damage of locking lances.

SUMMARY

The invention is directed to a connector with at least two housings to be assembled in a mutually laminated state. The housings include facing surfaces that face each other at the time of assembling. Locking lances are arranged to be exposed on the facing surfaces and cavities and project into the cavities. Terminal fittings are inserted into the cavities before the housings are assembled. The terminal fittings interfere with the locking lances and are deformed resiliently so that the locking lances project out from the facing surfaces during the insertion. However, the locking lances resiliently return to retain and lock the terminal fittings when the insertion is completed. The locking lances of the housings are arranged back-to-back when the housings are assembled. A surface of the locking lance facing the cavity on a tip part in a projecting direction is continuous without any step and includes a locking surface configured to lock the terminal fitting.

The locking lances are arranged back-to-back when the two housings are assembled. Thus, a deflection space between the locking lances can be reduced or eliminated so that the connector can be miniaturized and the terminal fittings can be retained firmly by the locking lances.

The surface of the locking lance facing the cavity on the tip part in the projecting direction includes the locking surface configured to lock the terminal fitting on the tip in the projecting direction. Thus, long shear distances along a pull-out direction of the terminal fittings can be ensured. As a result, even if the locking lances become smaller as the connector is miniaturized, a situation where the locking lances are sheared and broken can be prevented.

The locking lances contact each other and the locking surfaces thereof are continuous and flush with each other when the housings are assembled. Additionally, no step is provided between the locking surfaces of the respective locking lances. Thus, external matter will not be caught between the locking surfaces and breakage of the locking lances can be prevented more reliably.

DETAILED DESCRIPTION

Figure 4:
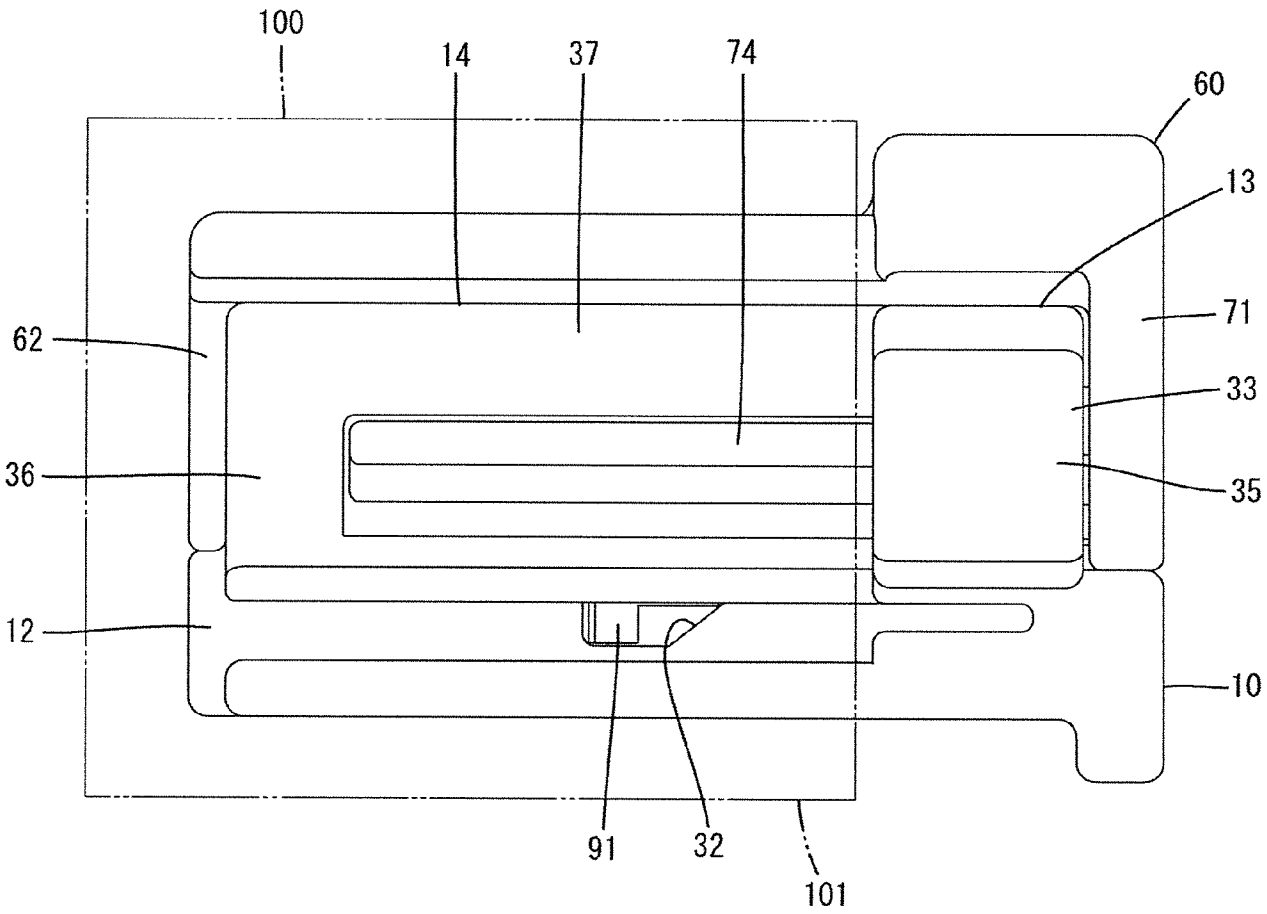
FIG. 4 is a side view showing a state where the first and second housings are assembled in the laminated state and connected to a mating housing.
Figure 5:
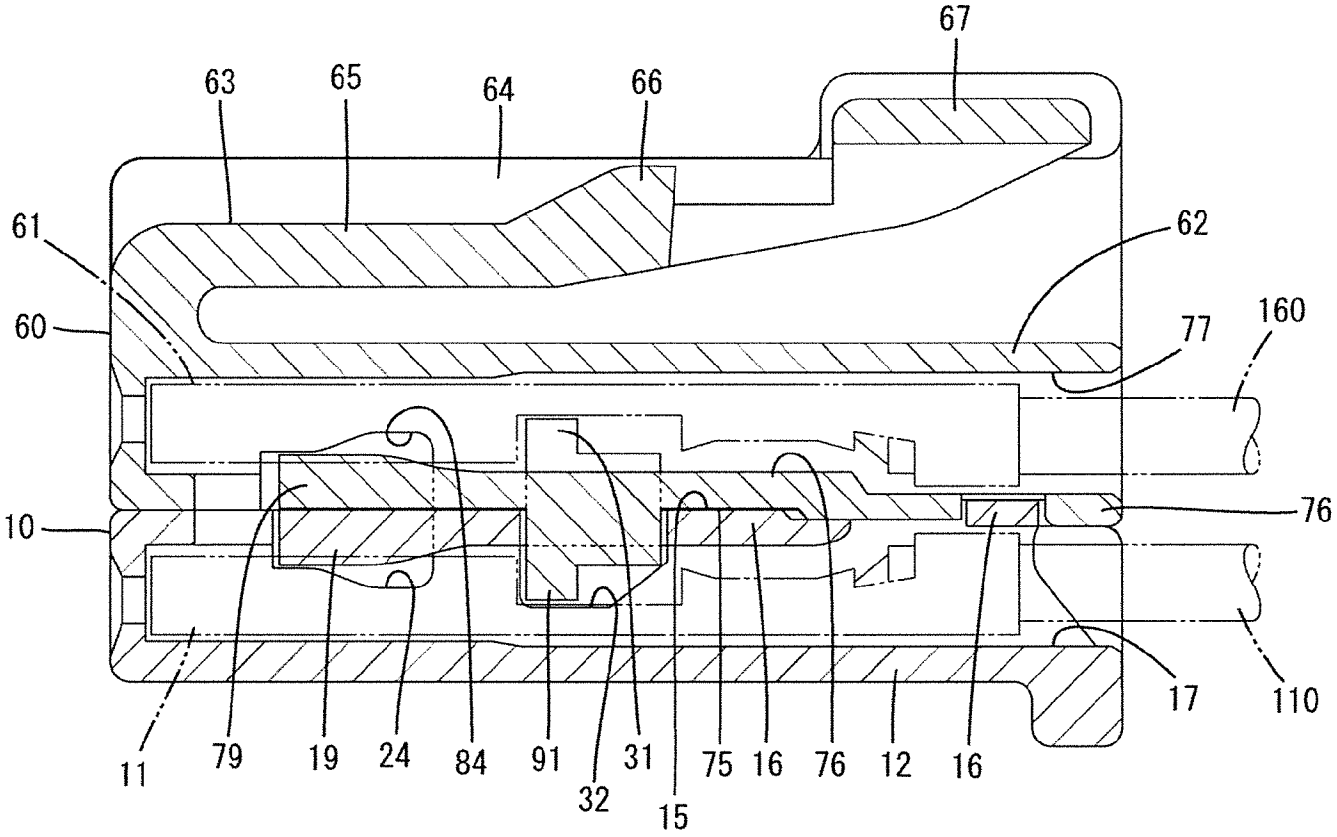
FIG. 5 is a view showing a state where the first and second housings in the assembled state are cut along first and second cavities.

A connector in accordance with an embodiment is described with reference to FIGS. 1 to 14. The connector of this embodiment includes first and second housings 10, 60 to be assembled in a laminated state, as shown in FIG. 5, and first and second terminal fittings 11, 61 to be accommodated respectively into the first and second housings 10, 60. As shown in FIG. 4, the first and second housings 10, 60 that have been assembled with one another are connectable to a mating housing 100 from the front (left side in FIG. 4).

The first and second terminal fittings 11, 61 are long and narrow in a front-back direction, as shown in FIG. 5, and are formed into the same shape by bending an electrically conductive metal plate. Rear ends of the first and second terminal fittings 11, 61 are crimped and connected to end parts of wires 110, 160. Front parts of the first and second terminal fittings 11, 61 are box-shaped, and male tabs of unillustrated mating terminal fittings are inserted therein and electrically connected when the first and second housings 10, 60 are connected properly.

Figure 6:
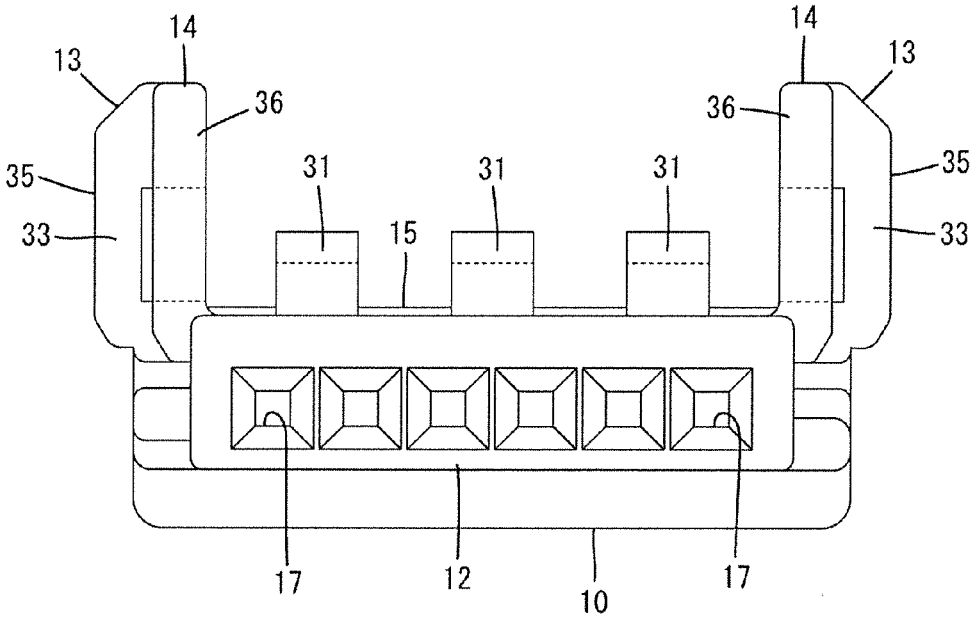
FIG. 6 is a front view of the first housing.
Figure 8:
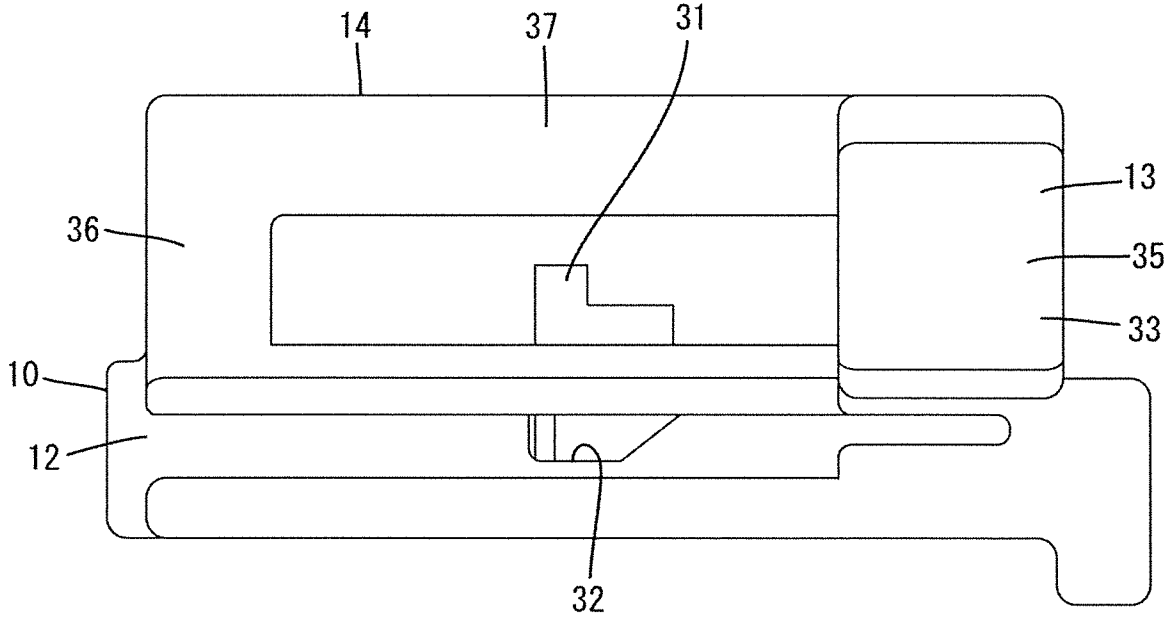
FIG. 8 is a side view of the first housing.

The first housing 10 is made of synthetic resin and, as shown in FIGS. 1 to 5, is arranged below the second housing 60 when the housings 10, 60 are assembled. As shown in FIGS. 6 and 8, the first housing 10 includes a first housing main body 12 in the form of a flat rectangular block. Two locks 13 project up from upper parts of the rear ends of both left and right sides of the first housing main body 12 and two bridges 14 link upper end parts of the locks 13 and upper edge parts of the front ends of the left and right sides of the first housing main body 12.

Figure 9:
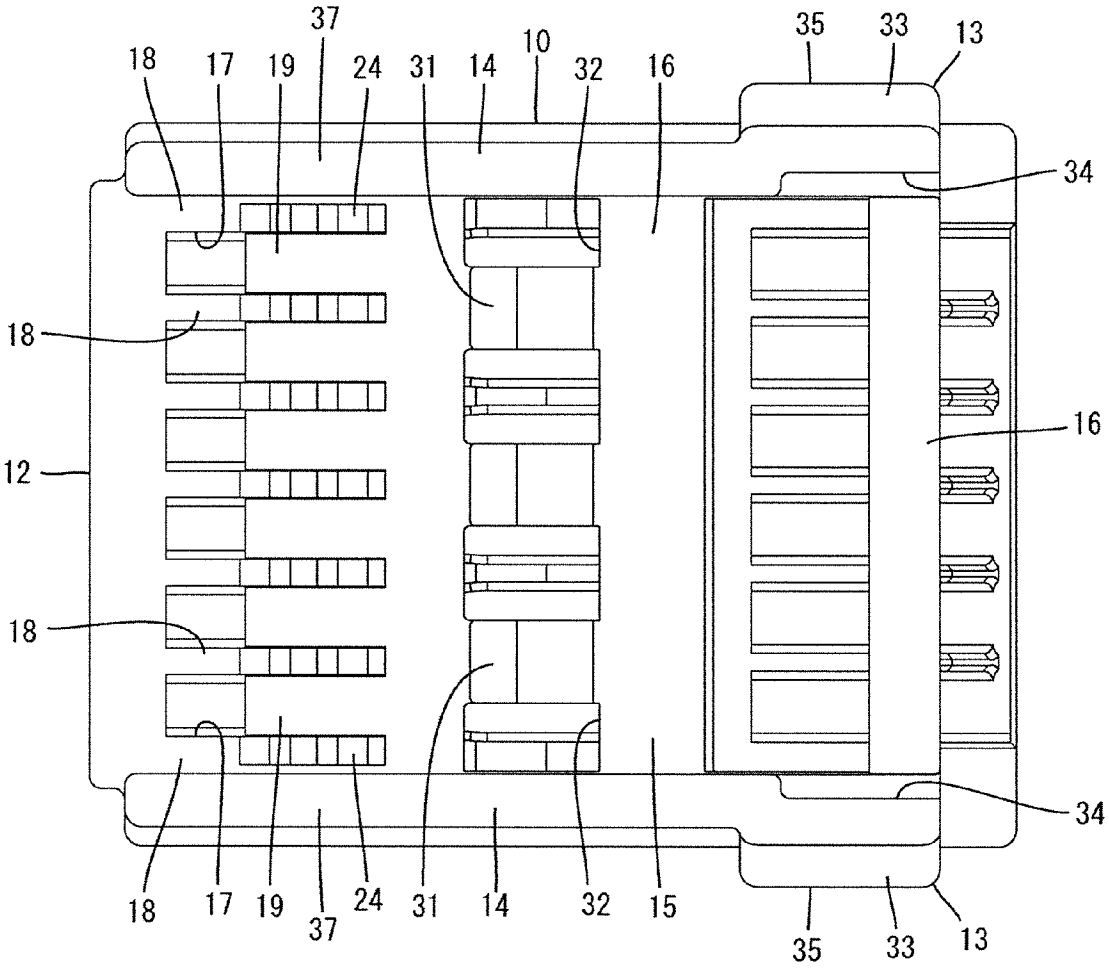
FIG. 9 is a plan view of the first housing.

As shown in FIG. 9, the upper surface of the first housing main body 12 defines a first facing surface 15 that faces the second housing 60 at the time of assembling. The locks 13 and the bridges 14 are arranged while being paired at left and right sides across the first facing surface 15. The first facing surface 15 of the first housing main body 12 is closed by first covering walls 16 in the form of rectangular plates laid in a lateral direction. First covering walls 16 are arranged while being spaced apart in the front-back direction (see FIG. 5).

Figure 3:
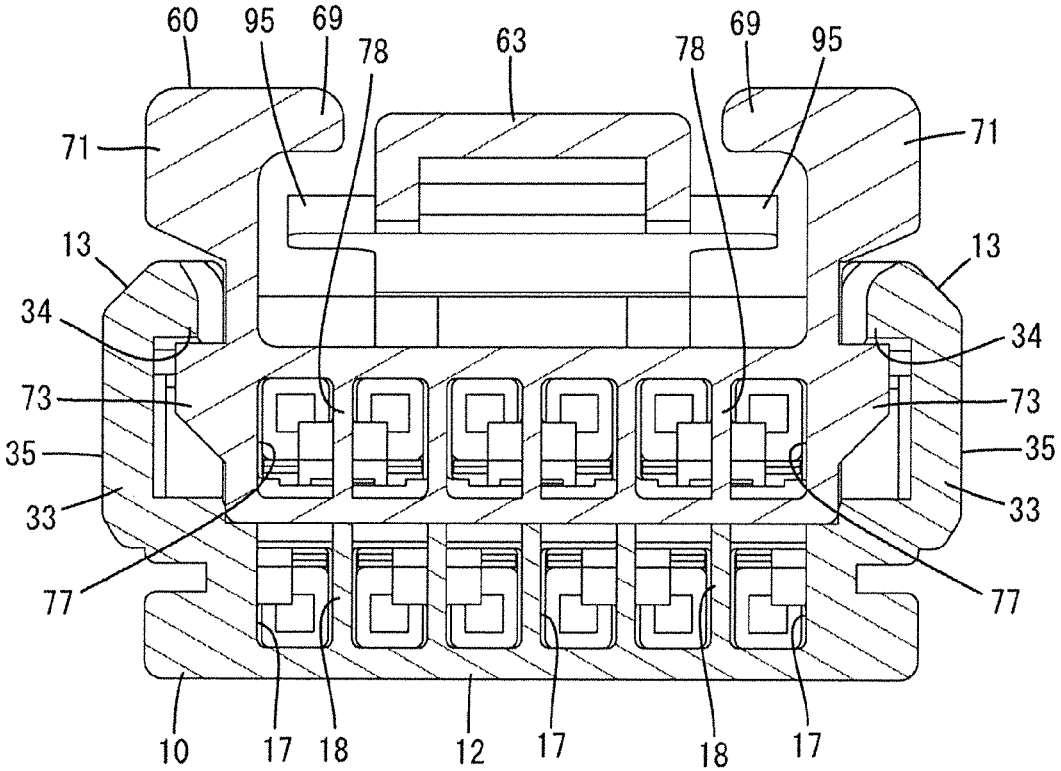
FIG. 3 is a view showing a state where the first and second housings in the assembled state are cut at parts corresponding to lock portions and lock receiving portions.

First cavities 17 are arranged laterally in a row in the first housing main body 12, as shown in FIGS. 6 and 9, and thin first partition walls 18 are between the laterally adjacent first cavities, as shown in FIGS. 3 and 9. The first terminal fittings 11 are inserted into the first cavities 17 from behind, as shown in FIG. 5. Upper ends of each first cavity 17 and each first partition wall 18 are open at front and rear ends across each first covering wall 16 on the first facing surface 15.

As shown in FIG. 5, a first locking lance 19 is cantilevered forward from the front end of the first covering wall 16 and projects into the first cavity 17 of the first housing main body 12. The first locking lance 19 is resiliently lockable to the first terminal fitting 11. The upper or outer surface of the first locking lance 19 is a flat surface extending along the front-back direction and is exposed on the first facing surface 15, as shown in FIG. 9. The outer surface of the first locking lance 19 is continuous with the first facing surface 15 of the first covering wall 16 without any step in the front-back direction.

Figure 13:
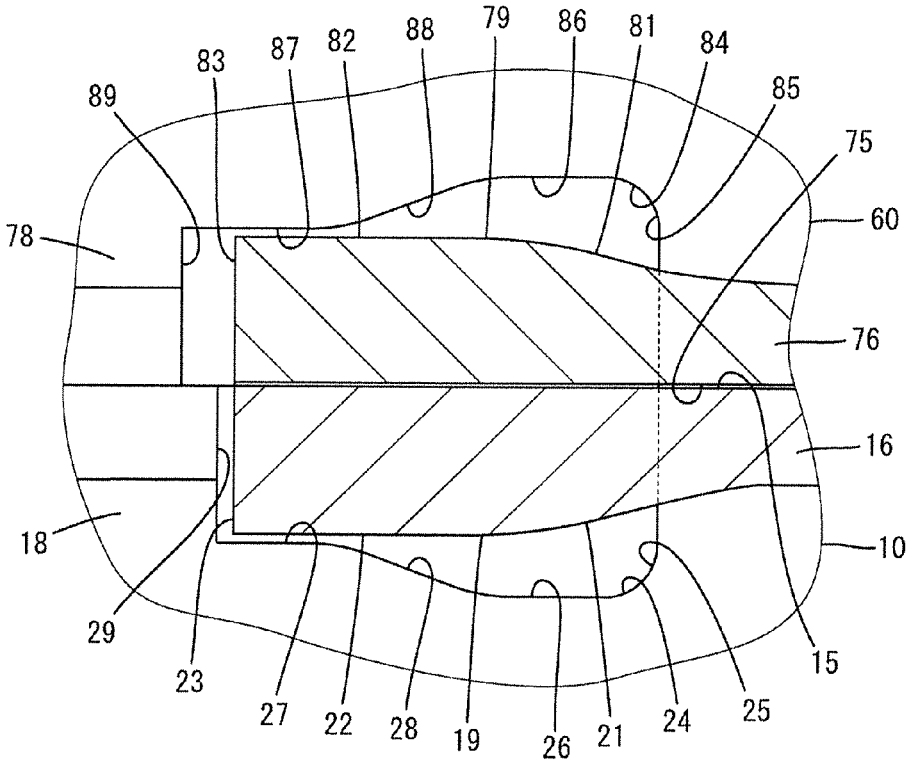
FIG. 13 is an enlarged view showing a state where the first and second housings in the assembled state are cut at parts corresponding to first and second cut portions.

Further, as shown in FIG. 13, the inner surface of the first locking lance 19 is composed of a first inclined part 21 moderately inclined down to the front from the inner surface of the first covering wall 16 and a first straight part 22 extending substantially straight in the front-back direction from the front end of the first inclined part 21 to the front end of the first locking lance 19. The inner surface of the first locking lance 19 is continuous without any step in the front-back direction from the first inclined part 21 to the first straight part 22. The front end surface of the first locking lance 19 defines a first locking surface 23 extending substantially along a vertical direction and is connected substantially at a right angle to the front end of the first straight part 22.

As shown in FIG. 9, each first partition wall 18 has a first cut portion 24 at a position laterally adjacent to the first locking lance(s) 19. As shown in FIG. 13, the first cut portion 24 defines a recess open on the upper end of the first partition wall 18. A first guide edge 25 of the first cut portion 24 extends from a rear end of the first locking lance 19 and defines a support for deflection of a front end of the first locking lance 19. A jig 200 (see FIGS. 14A and 14B) can be inserted into the first cut portion 24 and a releasing operation of the jig 200 is guided along the first guide edge 25 for releasing a locking state of the first locking lance 19.

Specifically, as shown in FIG. 13, the first guide edge 25 includes a first rear edge 26 deeply recessed to a position lower than the first inclined part 21, a first front edge 27 recessed to substantially the same height position as the first straight part 22 and a first oblique edge 28 inclined up from the first rear edge 26 to the first front edge 27. The rear end of the first rear edge 26 is at substantially the same position as the rear end of the first locking lance 19 in the front-back direction, and the front end of the first front edge 27 is before the front end of the first locking lance 19. The first cut portion 24 includes a first stopper edge 29 extending substantially vertically from the front end of the first front edge 27 to the upper end of the first partition wall 18.

Figure 2:
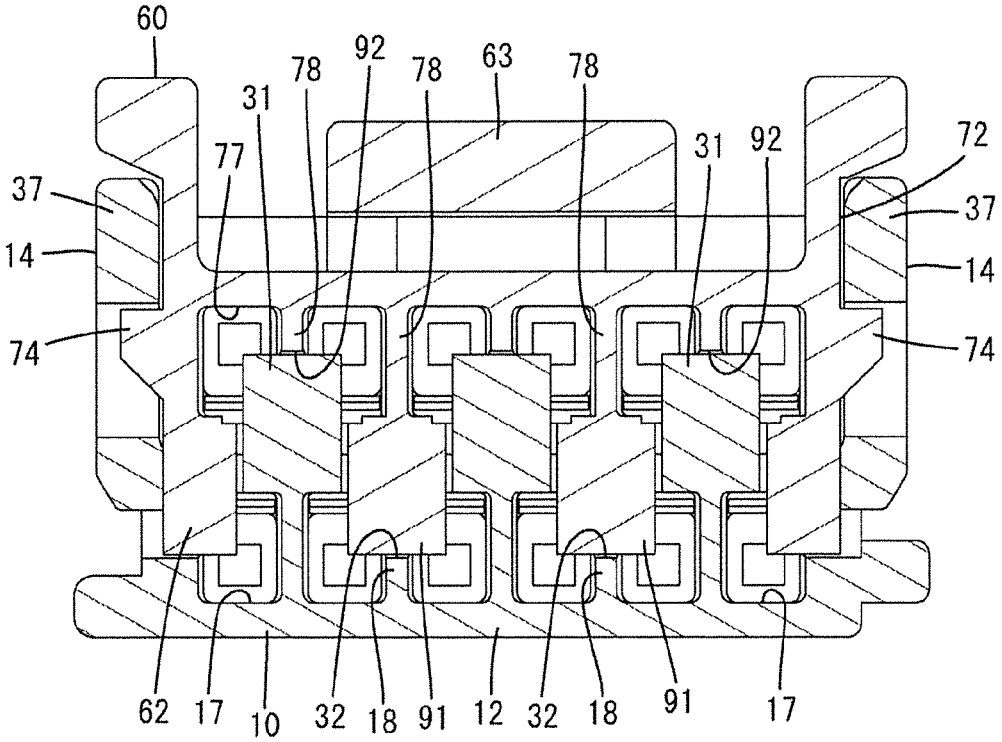
FIG. 2 is a view showing a state where the first and second housings in an assembled state are cut at parts corresponding to first and second retaining portions and first and second retention receiving portions.

As shown in FIG. 9, the first facing surface 15 of the first covering wall 16 has first retaining portions 31 and first retention receiving portions 32 in a substantially central part of the first housing main body 12 in the front-back direction. The first retaining portions 31 and the first retention receiving portions 32 are arranged laterally alternately to correspond to the respective first partition walls 18. Specifically, the first retaining portion 31 is a substantially rectangular block projecting up of the corresponding partition wall 18, as shown in FIG. 2 and the front surface extends substantially vertically, as shown in FIG. 8. As shown in FIG. 2, the first retention receiving portion 32 recesses the upper end of the corresponding partition wall 18. The first retaining portion 31 is inserted into a second retention receiving portion 92 to be described later and retains and locks the second terminal fitting 61 inserted into a later-described second cavity 77 of the second housing 60. The first retention receiving portion 32 functions to receive a second retaining portion 91 to be described later and brings the second retaining portion 91 to a position where the second retaining portion 91 is lockable to the first terminal fitting 11, as shown in FIG. 5.

Figure 7:
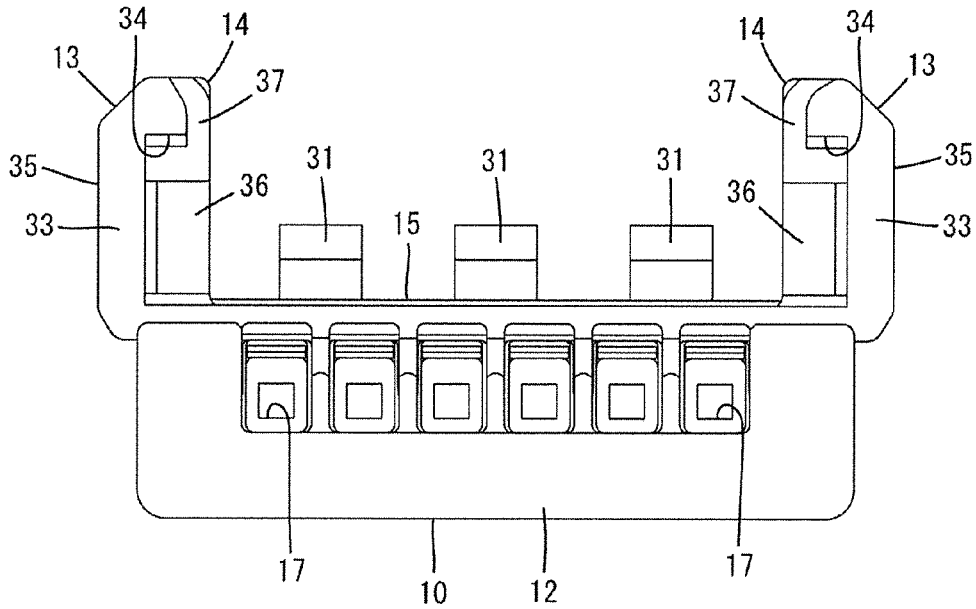
FIG. 7 is a rear view of the first housing.

As shown in FIGS. 6 to 8, the locks 13 are composed of lock main bodies 33 and lock projections 34. The lock main bodies 33 are rectangular plates standing up from upper edges of the rear ends of the left and right sides of the first housing main body 12. The lock projections 34 define claws protruding in from the upper ends of the lock main bodies 33. The locks 13 resiliently lock later-described lock receiving portions 73 to maintain the assembled state of the first and second housings 10, 60.

As shown in FIGS. 6, 7 and 9, the lock main bodies 33 stand up after protruding laterally out from the upper end of the first housing main body 12. An exposed surface 35 is provided on the outer surface of the lock main body 33 and extends vertically and in the front-back direction. The exposed surface 35 of the lock main body 33 is at a position projecting laterally out of the side surface of the first housing main body 12 and, as shown in FIG. 4, is exposed to the outside of the mating housing 100 with the first and second housings 10, 60 properly connected to the mating housing 100. As shown in FIG. 7, the inner surface of the lock main body 33 is arranged along the vertical direction and the front-back direction and is at substantially the same position as the side surface of the first housing main body 12 in the lateral direction.

The lock projection 34 is a rectangular rib projecting in along the lateral direction, as shown in FIG. 7, and extends over substantially the entire length in the front-back direction along the upper end of the lock main body 33, as shown in FIG. 9.

As shown in FIG. 8, the bridges 14 are composed of front walls 36 and bridging walls 37. The front walls 36 stand up from upper edges of the front ends of the left and right sides of the first housing main body 12. The bridging walls 37 extend in the front-back direction and have the front ends coupled to the front walls 36 and the rear ends coupled to upper end parts of the lock main bodies 33. Both the front walls 36 and the bridging walls 37 are in the form of rectangular plates extending along the vertical direction and the front-back direction. The bridges 14 function to reinforce the locks 13 and regulate inadvertent widening of the locks 13.

As shown in FIG. 9, the rear end of the bridging wall 37 is coupled integrally to the lock projection 34 and the inner surface thereof is connected to the inner surface of the lock projection 34 via a step that is more inward than the inner surface of the lock projection 34. Further, the outer surface of the bridge 14 is inward of the exposed surface 35 of the lock main body 33.

Figure 10:
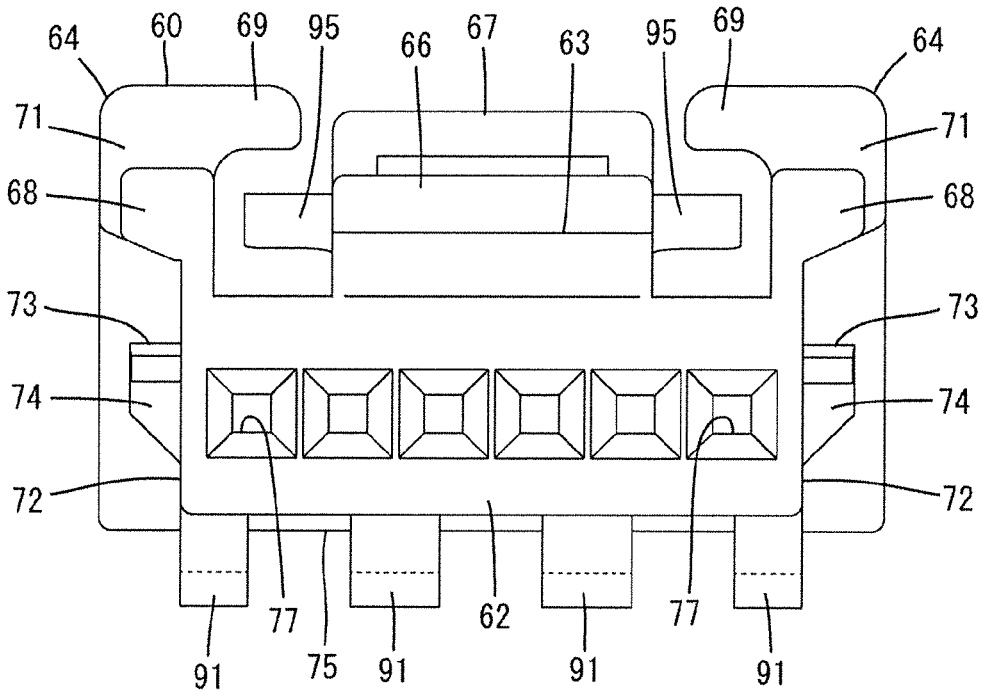
FIG. 10 is a front view of the second housing.

The second housing 60 is made of synthetic resin and includes a second housing main body 62 in the form of a flat rectangular block, as shown in FIG. 10. A lock arm 63 is disposed on a lateral central part of the upper surface of the second housing main body 62 and protection walls 64 are disposed at left and right sides of the lock arm 63 on the upper surface of the second housing main body 62.

As shown in FIG. 5, the lock arm 63 includes an arm main body 65 that stands up from the front end of the upper surface of the second housing main body 62 and then extends back. A locking protrusion 66 projects up at an intermediate position in the front-back direction and a releasing portion 67 is slightly higher at a rear end part of the arm main body 65.

The first and second housings 10, 60 can be assembled and fit into a receptacle 101 of the mating housing 100 (see FIG. 4). The arm main body 65 initially deflects, but then the locking protrusion 66 resiliently locks the receptacle 101 to maintain the first and second housings 10, 60 in a state where separation from the mating housing 100 is regulated. Further, the locked state of the locking protrusion 66 can be released by pressing the releasing portion 67 and then the first and second housings 10, 60 can be pulled apart from each other.

As shown in FIG. 10, the protection walls 64 include standing walls 68 standing from left and right sides of the upper surface of the second housing main body 62 and a regulating piece 69 protrudes in from the upper end of each standing wall 68. The standing walls 68 are plates that extend along the front-back direction and cover side surfaces of the lock arm 63. The regulating pieces 69 contact receiving pieces 95 that protrude from left and right sides of the arm main body 65 when the arm main body 65 is going to be deflected up, which is opposite to a proper direction, thereby regulating excessive upward deflection and deformation of the arm main body 65.

Figure 1:
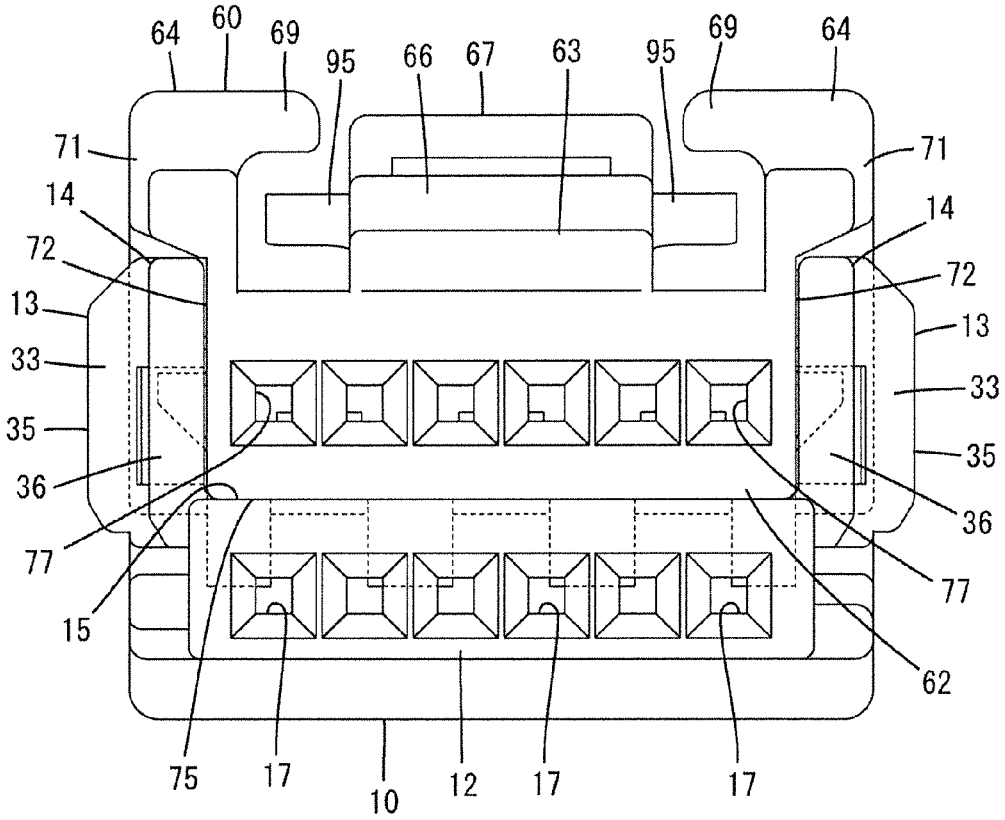
FIG. 1 is a front view showing a state where first and second housings are assembled in a laminated state in a connector according to an embodiment of the present invention.

Two ribs 71 are provided in ranges from upper end parts to rear end parts of the protection walls 64 on the left and right side surfaces of the second housing 60 (FIG. 4), and are L-shaped in side view, as shown in FIG. 4. Two mounting recesses 72 are provided inward of the ribs 71 and open forward and downward, as shown in FIG. 1. The bridges 14 and the lock projections 34 of the locks 13 fit into the mounting recesses 72 when the first and second housings 10, 60 are assembled.

Figure 11:
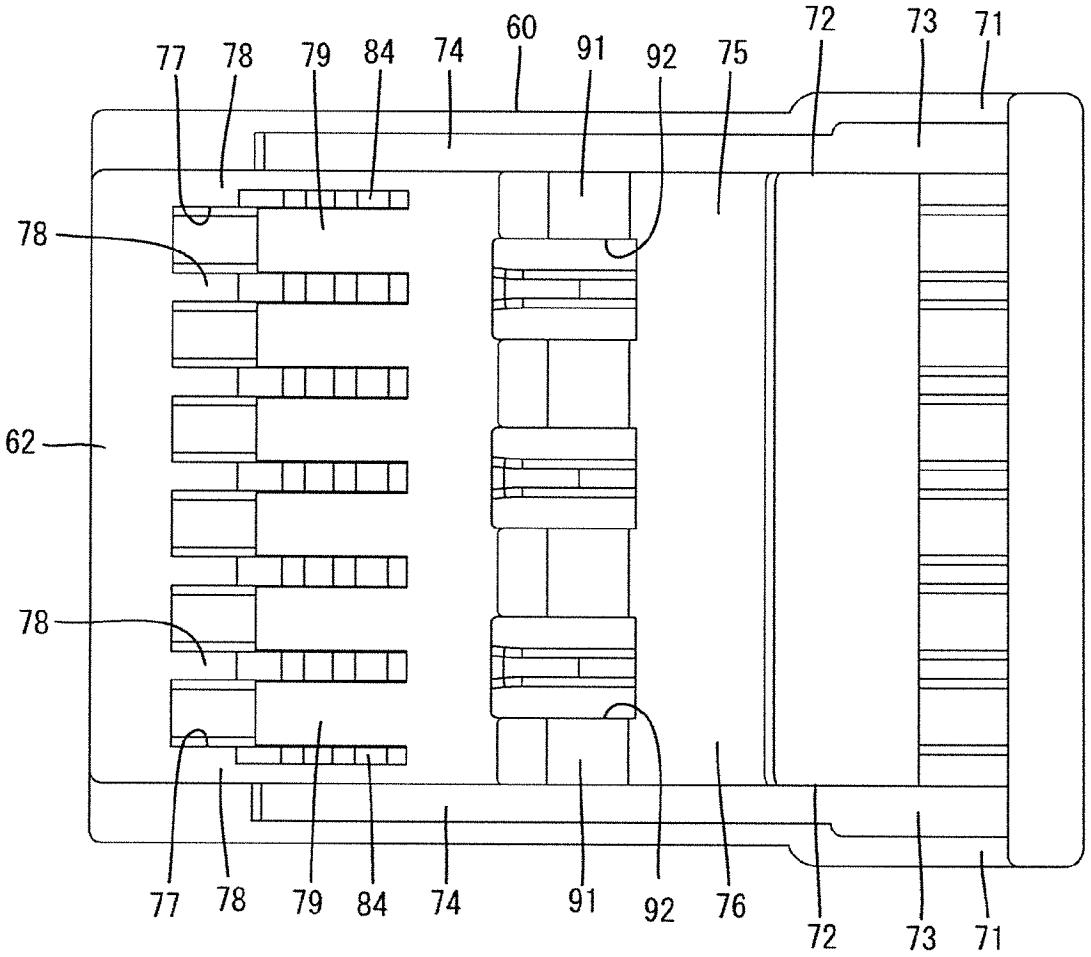
FIG. 11 is a bottom view of the second housing.

As shown in FIGS. 10 and 11, the lock receiving portion 73 projects on a rear end part of the back surface of the mounting recess 72 of the second housing 60. The lock receiving portion 73 is a rib extending in the front-back direction and the upper surface thereof is flat in the lateral direction. Further, a fitting portion 74 is provided on the back surface of the mounting recess 72 of the second housing 60 and defines a rib extending in the front-back direction. The fitting portion 74 is longer than the lock receiving portion 73 and the rear end thereof is coupled integrally to the lock receiving portion 73. The upper surface of the fitting portion 74 is at a position slightly lower than the upper surface of the lock receiving portion 73.

As shown in FIGS. 1 and 5, the lower surface of the second housing 60 defines a second facing surface 75 and is arranged to face the first housing 10 when assembled. As shown in FIG. 11, the second facing surface 75 is closed by second covering walls 76 in the form of rectangular plates laid in the lateral direction.

Second cavities 77 are arranged in a lateral row in the second housing main body 62. As shown in FIG. 5, the second terminal fitting 61 is inserted into the second cavity 77 from behind. As shown in FIG. 11, the laterally adjacent second cavities 77 are partitioned by thin second partition walls 78. Upper ends of each second cavity 77 and each second partition wall 78 are open at front and rear sides across the second covering walls 76 on the second facing surface 75.

As shown in FIG. 5 second locking lances 79 are cantilevered forward from the front end of the second covering wall 76 and project into the second cavities 77 of the second housing main body 62. Each second locking lance 79 is resiliently lockable to the second terminal fitting 61. The outer surface (lower surface) of the second locking lance 79 is a flat surface extending along the front-back direction and is arranged to be exposed on the second facing surface 75, as shown in FIG. 11. The outer surface of the second locking lance 79 is continuous with the second facing surface 75 of the second covering wall 76 without any step in the front-back direction.

As shown in FIG. 13, the inner surface (surface facing the second cavity 77) of the second locking lance 79 has a second inclined part 81 inclined moderately up to the front from the inner surface of the second covering wall 76 and a second straight part 82 extending substantially straight in the front-back direction from the front of the second inclined part 81 to the front of the second locking lance 79. The inner surface of the second locking lance 79 is continuous without a step in the front-back direction from the second inclined part 81 to the second straight part 82. The front end of the second locking lance 79 forms a second locking surface 83 extending vertically and is connected substantially at a right angle to the front end of the second straight part 82.

As shown in FIG. 13, the first and second locking lances 19, 79 are shaped identically and are arranged vertically symmetrically across the first and second facing surfaces 15, 75 when the first and second housings 10, 60 are assembled.

As shown in FIG. 11, each second partition wall 78 has a second cut portion 84 at a position laterally adjacent to the second locking lances 79. As shown in FIG. 13, the second cut portion 84 is a recess that is open on the lower end of the second partition wall 78 and includes a second guide edge 85 extending from a rear supporting end of the second locking lance 79 toward the free front end of the second locking lance 79. The jig 200 (see FIGS. 14A and 14B) for releasing a locking state of the second locking lance 79 can be inserted into the second cut portion 84 and guided along the second guide edge 85.

As shown in FIG. 13, the second guide edge 85 includes a second rear edge 86 deeply recessed to a position higher than the second inclined part 81 in the vertical direction, a second front edge 87 recessed to substantially the same height as the second straight part 82 and a second oblique edge 88 inclined down from the second rear edge 86 to the second front edge 87. The rear end of the second rear edge 86 is at substantially the same position as a rear end of the second locking lance 79 in the front-back direction, and the front end of the second front edge 87 is before the front end of the second locking lance 79. The second cut portion 84 includes a second stopper edge 89 extending substantially vertically from the front end of the second front edge 87 to the upper end of the second partition wall 78.

Figure 12:
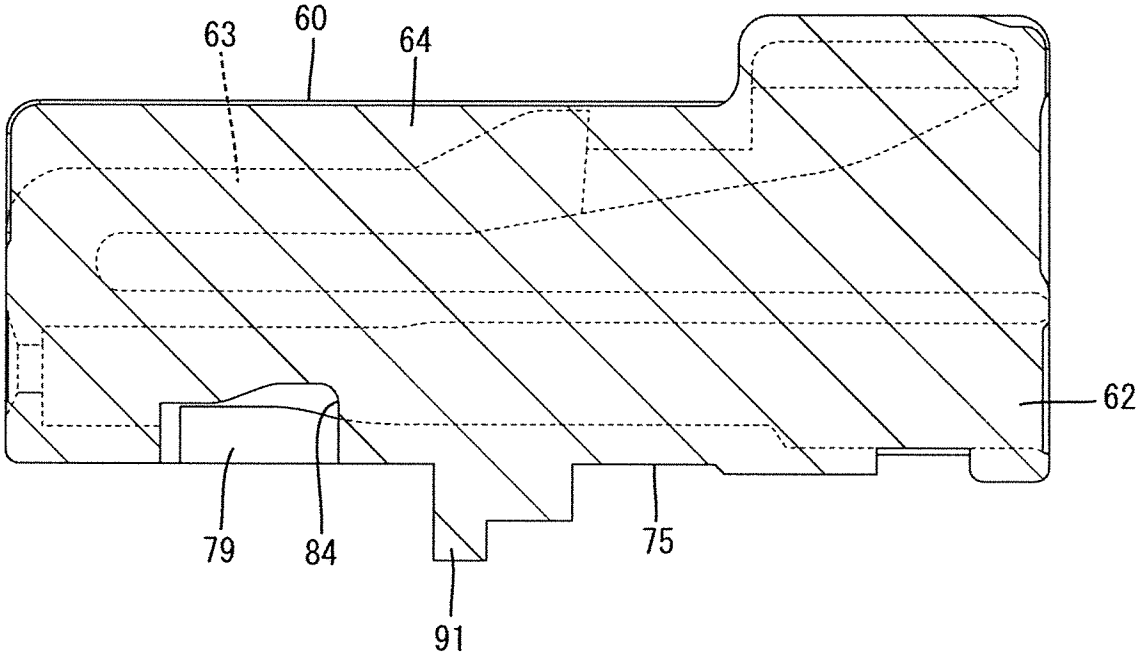
FIG. 12 is a view showing a state where the second housing is cut at a part corresponding to a second cut portion.

As shown in FIG. 11, the second facing surface 75 of the second covering wall 76 has a plurality of second retaining portions 91 and a plurality of second retention receiving portions 92 in a substantially central part of the second housing main body 62 in the front-back direction. The second retaining portions 91 and the second retention receiving portions 92 are arranged alternately in the lateral direction to correspond to the respective second partition walls 78. Specifically, the second retaining portion 91 is a substantially rectangular block projecting down of the corresponding partition wall 78, as shown in FIG. 2, and the front surface extends substantially vertically, as shown in FIGS. 5 and 12. As shown in FIG. 2, the second retention receiving portion 92 recesses the lower end of the corresponding partition wall 78. Each second retaining portion 91 is at a position corresponding to each first retention receiving portion 32 and each second retention receiving portion 92 is at a position corresponding to each first retaining portion 31.

As shown in FIG. 2, the first retaining portion 31 is inserted into the second retention receiving portion 92, and the second retaining portion 91 is inserted into the first retention receiving portion 32 when the first and second housings 10, 60 are assembled. Then, as shown in FIG. 5, the first and second retaining portions 31, 91 face and lock the second and first terminal fittings 61, 11 so that backward detachment of the first and second terminal fittings 11, 61 from the first and second cavities 17, 77 is regulated reliably. The first retaining portions 31 are fit into the second retention receiving portions 92 and inserted over the adjacent second cavities 77, and the second retaining portions 91 are fit into the first retention receiving portions 32 and inserted over the adjacent first cavities 17. Thus, the first and second terminal fittings 11, 61 are locked efficiently while saving space.

The first terminal fittings 11 are inserted into the first cavities 17 of the first housing main body 12 when the first housing 10 is in a single state. Thus, the front end of the first terminal fitting 11 slides on the first inclined part 21 of the first locking lance 19 and the first locking lance 19 deflects with the rear end as a support. At this time, the deflected and deformed first locking lance 19 projects out from the first facing surface 15. The insertion of the first terminal fitting 11 is completed when the first terminal fitting 11 contacts the front wall of the first housing main body 12. At this time, the first locking lance 19 resiliently returns and the first locking surface 23 of the first locking lance 19 faces and locks to the front end part of the first terminal fitting 11. In this way, the first terminal fitting 11 is held in the first cavity 17 of the first housing main body 12 in a state where backward detachment is regulated. Note that the second terminal fitting 61 is inserted into the second cavity 77 in a similar procedure when the second housing 60 is in a single state.

Subsequently, the second housing 60 is assembled with the first housing 10 from above with the second facing surface 75 of the second housing main body 62 facing the first facing surface 15 of the first housing main body 12 (see FIGS. 1 and 5). In the process of assembling the first and second housings 10, 60, the lock projections 34 slide on the lock receiving portions 73 to deflect and deform the locks 13 outward, and the bridging walls 37 slide on the fitting portions 74 to deflect and deform the bridges 14 outwardly.

The locks 13 resiliently return when the first and second housings 10, 60 are assembled properly and the lock projections 34 face and lock to the upper surface of the lock receiving portions 73 (see FIG. 3). Additionally, the bridges 14 resiliently return to fit into the fitting portions 74, and the bridging walls 37 face the upper surface of the fitting portions 74 (see FIG. 2). At this time, the lock projections 34 of the locks 13 and the bridges 14 are fit into the mounting recesses 72 and upper and rear parts thereof are covered and protected by the ribs 71. Further, the lock main bodies 33 of the locks 13 project out from peripheral parts of the left and right side surfaces of the first and second housings 10, 60 when the first and second housings 10, 60 are assembled properly (see FIG. 1). However, the locks 13 are coupled integrally to the bridges 14, and not opened and deformed easily even if external matter interferes from outside. Thus, a locked state of the locks 13 and the lock receiving portions 73 can be maintained stably.

When the first and second housings 10, 60 are assembled, the first and second covering walls 16, 76 are arranged in contact with each other and a rear end part of the first covering wall 16 is fit into an open part between the second covering walls 76 (see FIG. 5). Further, the first and second locking lances 19, 79 face each other in a back-to-back state and contact along the front-back direction when the first and second housings 10, 60 are assembled (see FIGS. 5 and 13). Specifically, the first and second locking lances 19, 79 contact substantially over the entire lengths in the front-back direction, and the first and second locking surfaces 23, 83 are aligned at the same position in the front-back direction and without any step in the vertical direction.

The front part of the first terminal fitting 11, the first locking lance 19, the front part of the second terminal fitting 61 and the second locking lance 79 are arranged side by side without any substantially clearance in a vertical range of the first and second cavities 17, 77 (see FIG. 5). Thus, a resilient displacement of the first locking lance 19 in a direction to release locking with the first terminal fitting 11 (up) is regulated by the second locking lance 79, and a resilient displacement of the second locking lance 79 in a direction to release the locking with the second terminal fitting 61 (down) is regulated by the first locking lance 19. Accordingly, when the first and second housings 10, 60 are assembled, the first terminal fitting 11 is locked triply by the first and second locking lances 19, 79 and the second retaining portion 91, and the second terminal fitting 61 is locked triply by the first and second locking lances 19, 79 and the first retaining portion 31.

The first locking surface 23 of the first locking lance 19 faces and is lockable to the front of the first terminal fitting 11. Thus, a long shear distance is ensured in a range from the first locking surface 23, which is the projecting end of the first locking lance 19, to a position beyond the first straight part 22. Similarly, a long shear distance is ensured in a range from the second locking surface 83 of the second locking lance 79 to a position beyond the second straight part 82. Thus, even if a pull-out force acts on the first or second terminal fitting 11, 61, such as by the wire 110, 160 being pulled backward, the first or second locking lance 19, 79 will not be sheared and the state of the first or second locking lance 19, 79 locking the first or second terminal fitting 11, 61 is stable.

Subsequently, the assembled first and second housings 10, 60 are connected to the mating housing 100 (see FIG. 4). At this time, an operator can perform a connecting operation while placing fingers on the exposed surfaces 35 of the lock main bodies 33 and gripping the exposed surfaces 35 of the lock main bodies 33 from opposite left and right sides. The exposed surfaces 35 of the lock main bodies 33 project from the surrounding parts of the left and right side surfaces of the first and second housings 10, 60, and easily can be recognized by the operator and the lock main bodies 33 can be gripped in preference to other parts.

When the first and second housings 10, 60 are connected properly to the mating housing 100, the bridges 14 enter the receptacle 101 of the mating housing 100. However, the locks 13 are exposed to the outside of the mating housing 100 (see FIG. 4). Thus, fingers can be placed on the exposed surfaces 35 of the locks 13 until the first and second housings 10, 60 are connected properly to the mating housing 100. Further, when the first and second housings 10, 60 are connected properly to the mating housing 100, the front ends of the ribs 71 and those of the lock main bodies 33 of the locks 13 face proximately and parallel to the opening end of the receptacle 101.

The first and second terminal fittings 11, 61 may have to be withdrawn from the first and second housings 10, 60 for various reasons, such as maintenance. Thus, the first and second housings 10, 60 need to be separated first from the mating housing 100. At this time, the locking state of the lock arm 63 is released by pressing the releasing portion 67 and, thereafter, the first and second housings 10, 60 are pulled apart from the mating housing 100 while fingers are placed on the exposed surfaces 35 of the lock main bodies 33.

Figure 14A:
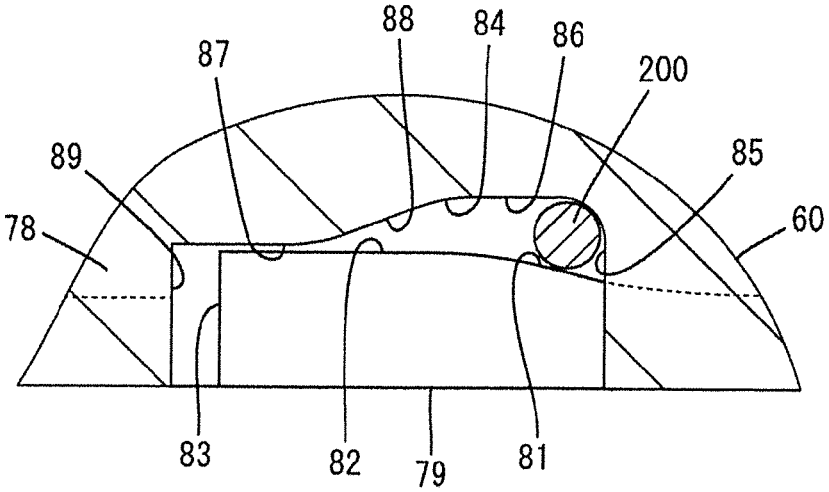
FIG. 14A is an enlarged view showing a state where a tip part of a jig is inserted into the second cut portion to be engageable with a rear end part of a second locking lance and FIG. 14B is an enlarged view showing a state where the tip part of the jig is slid along a second guide edge of the second cut portion.
Figure 14B:
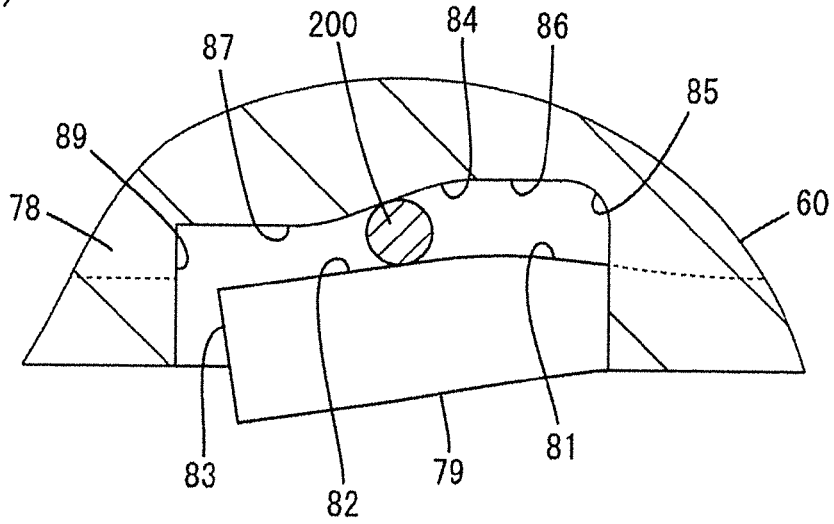

Subsequently, the locked state of the locks 13 and the lock receiving portions 73 is released, and the first and second housings 10, 60 are pulled apart and returned to the single state. The first and second terminal fittings 11, 61 then are withdrawn from the first and second cavities 17, 77 of the first and second housings 10, 60. The substantially L-shaped or T-shaped bar-like jig 200 (cross-sectional shape of a tip part is shown in FIGS. 14A and 14B) may be used to withdraw the second terminal fitting 61. The jig 200 is inserted into the second cut portion 84 through an opening part of the second cut portion 84 on the second facing surface 75 of the second housing 60 and twisted substantially 90° in the second cut portion 84 and the tip of the jig 200 is arranged to face and contact the inner surface of the rear part of the second locking lance 79 (FIG. 14A).

The tip of the jig 200 is slid along the second guide edge 85 (see FIG. 14B). At this time, the jig 200 is slid from the second rear edge 86 to the second front edge 87 via the second oblique edge 88 and a part opposite to that sliding side is slid from the second inclined part 81 to the second straight part 82 of the second locking lance 79. By sliding the jig 200 from the side of the support of deflection of the second locking lance 79 toward the free end along the second guide edge 85, the second locking lance 79 is pressed by the jig 200 and gradually deflected and in a direction to release the locking with the second terminal fitting 61. An operation force is not directly applied to the second locking lance 79 in its deflecting direction in this case. Thus, the second locking lance 79 will not be deflected excessively deflected.

Thereafter, the jig 200 contacts the second stopper edge 89, and the locked state of the second locking lance 79 and the second terminal fitting 61 is released, with an advancing movement of the jig 200 regulated. Thus, the second locking lance 79 is deflected and deformed in a proper deflection range so that the second terminal fitting 61 can be pulled out from the second cavity 77. Note that a similar operation may be performed with respect to the first terminal fitting 11.

As described above, partition walls between deflection spaces for the first and second locking lances 19, 79 can be eliminated and the first and second housings 10, 60 can be reduced in height by that much since the first and second locking lances 19, 79 are exposed on the first and second facing surfaces 15, 75 that are the outer surfaces of the first and second housings 10, 60. Further, the first and second locking lances 19, 79 contact each other back-to-back when the first and second housings 10, 60 are assembled. Thus, the entire connector can be miniaturized.

The first and second locking lances 19, 79 can be deflected and deformed smoothly in the direction to release the locking with the first and second terminal fittings 11, 61. Excessive deflection of the first and second locking lances 19, 79 can be avoided (see FIG. 14B) by inserting the jig 200 through the openings on the first and second facing surfaces 15, 75, twisting the jig 200 and sliding the jig 200 along the first and second guide edges 25, 85 of the first and second cut portions 24, 84. As a result, the first and second locking lances 19, 79 will not break.

The operator becomes aware that a sliding operation of the jig 200 has been completed when the jig 200 contacts the first and second stopper edges 29, 89. Thus, a lock releasing operation of the first and second locking lances 19, 79 is stopped reliably before the first and second locking lances 19, 79 are deflected excessively.

Surfaces of the front parts of the first and second locking lances 19, 79 that face the first and second cavities 17, 77 are continuous without any step. Additionally, the front ends of the first and second locking lances 19, 79 include the first and second locking surfaces 23, 83 to lock the first and second terminal fittings 11, 61. Thus, shear distances along the withdrawing direction of the first and second terminal fittings 11, 61 are long. As a result, the first and second locking lances 19, 79 will not shear and break even if the first and second locking lances 19, 79 are small due to miniaturization of the first and second housings 10, 60.

Further, the first and second locking lances 19, 79 contact each other and the first and second locking surfaces 23, 83 are continuous and flush in the vertical direction when the first and second housings 10, 60 are assembled. There is no step between the first and second locking surfaces 23, 83. Thus, external matter cannot be caught by the front ends of the first and second locking lances 19, 79.

The locks 13 function to maintain the assembled state of the first and second housings 10, 60 by locking the lock receiving portions 73 and also form parts where fingers are placed when connecting the first and second housings 10, 60 to the mating housing 100. Thus, the configuration is simplified as compared to the case where both functions are provided separately.

Further, the lock main bodies 33 of the locks 13 have a thickness to face the opening end of the receptacle 101 at the time of connection to the mating housing 100 and the end surfaces of the lock main bodies 33 in a thickness direction form the exposed surfaces 35. Thus, the exposed surfaces 35 of the lock main bodies 33 can be recognized easily as finger placing surfaces when performing the connecting and separating operations to and from the mating housing 100.

Furthermore, the bridges 14 are laid integrally between the locks 13 and the first housing main body 12. Thus, inadvertent widening of the locks 13 can be suppressed by the bridges 14, the rigidity of the locks 13 can be enhanced and the assembled state of the first and second housing 10, 60 can be maintained stably.

Other embodiments are briefly described below.

An anti-slip portion may be provided on the exposed surface of the lock. The anti-slip portion may be configured, for example, by juxtaposing a multitude of convex and concave stripes on the exposed surface.

Slight clearances may be formed between the first and second locking lances when the first and second housings are assembled.

The invention in which the first and second cut portions are provided on the first and second partition walls is applicable also to a single housing that is not divided into first and second housings.

The locks may be provided on the second housing and the lock receiving portions may be provided on the first housing.

LIST OF REFERENCE SIGNS

10 . . . first housing
11 . . . first terminal fitting
13 . . . lock
14 . . . bridge
15 . . . first facing surface
17 . . . first cavity
18 . . . first partition wall
19 . . . first locking lance
23 . . . first locking surface
24 . . . first cut portion
25 . . . first guide edge
29 . . . first stopper edge
35 . . . exposed surface
60 . . . second housing
61 . . . second terminal fitting
73 . . . lock receiving portion
75 . . . second facing surface
77 . . . second cavity
78 . . . second partition wall
79 . . . second locking lance
83 . . . second locking surface
84 . . . second cut portion
85 . . . second guide edge
89 . . . second stopper edge
100 . . . mating housing
101 . . . receptacle
200 . . . jig

What is claimed is:

1. A connector, comprising:

first and second housings to be assembled in a mutually laminated state, the first and second housings including respectively first and second facing surfaces facing each other at the time of assembling, and at least one cavity formed in each of the first and second housings and extending in forward and backward directions;

at least first and second resiliently deformable locking lances cantilevered forward from the respective facing surfaces of the first and second housings, the at least first and second locking lances having an outer surface substantially continuous with the respective facing surfaces when the locking lances are in a non-deformed state, and an inner surface facing the cavity, the inner surface including an inclined part inclined away from the facing surface in a forward direction, and a straight part extending forward from the inclined part to a front end of the locking lance and being substantially parallel to the outer surface, the inclined part and the front part being continuous with one another without any step, and the front end of the locking lance defining a locking surface extending between the straight part and the outer surface and substantially normal thereto; and terminal fittings being inserted into the cavities before the housings are assembled, the terminal fittings resiliently deforming the locking lances during the insertion, the locking lances resiliently return and retain and lock the terminal fittings when the insertion is completed with the locking surfaces bearing against front end parts of the terminal fittings, and the locking lances of the housings are arranged back-to-back when the housings are assembled.

2. The connector of claim 1, wherein the locking lances of the housings come into contact with each other and the locking surfaces of the respective locking lances are arranged to be continuous and flush with each other when the housings are assembled.

* * * * *